US006715649B2

(12) United States Patent
Santagiuliana

(10) Patent No.: US 6,715,649 B2
(45) Date of Patent: Apr. 6, 2004

(54) BELLOWS PUMP FOR DELIVERY OF LIQUIDS

(75) Inventor: Stefano Santagiuliana, Caldogno (IT)

(73) Assignee: Taplast SPA, Dueville (IT)

( * ) Notice: Subject to any disclaimer, the term of this patent is extended or adjusted under 35 U.S.C. 154(b) by 0 days.

(21) Appl. No.: 10/258,813

(22) PCT Filed: May 25, 2001

(86) PCT No.: PCT/EP01/05975

§ 371 (c)(1),
(2), (4) Date: Oct. 28, 2002

(87) PCT Pub. No.: WO01/91911

PCT Pub. Date: Dec. 6, 2001

(65) Prior Publication Data

US 2003/0075567 A1 Apr. 24, 2003

(30) Foreign Application Priority Data

May 26, 2000 (IT) ..... VI2000A0111

(51) Int. Cl.[7] ..... B65D 5/42

(52) U.S. Cl. ..... 222/380; 222/383.3; 222/533; 222/536; 222/538

(58) Field of Search ..... 222/380, 383.1, 222/383.3, 533, 536, 538

(56) References Cited

U.S. PATENT DOCUMENTS 522,087 A * 6/1894 Rawhouser ..... 222/533
547,048 A * 10/1895 True ..... 222/533
3,089,626 A * 5/1963 Kubiliunas ..... 222/533
3,116,856 A * 1/1964 Prussin et al. ..... 222/536
3,907,174 A 9/1975 Steiman
4,234,127 A * 11/1980 Tada et al. ..... 222/533
4,272,228 A * 6/1981 Kutik et al. ..... 222/321.7
4,819,832 A * 4/1989 Lawson ..... 222/534
4,865,230 A 9/1989 Tugwood
5,791,518 A * 8/1998 Amann et al. ..... 222/538
5,871,126 A * 2/1999 Bennett et al. ..... 222/380
5,875,936 A * 3/1999 Turbett et al. ..... 222/536
5,988,434 A * 11/1999 Keil et al. ..... 222/536
6,105,826 A * 8/2000 Oursin et al. ..... 222/533
6,109,547 A * 8/2000 Ritsche ..... 222/538

* cited by examiner

*Primary Examiner*—Kenneth Bomberg
(74) *Attorney, Agent, or Firm*—Dykema Gossett PLLC

(57) ABSTRACT

The invention relates to a liquid delivery pump (1) connected to the neck of a container comprising: a cylindrical hollow body (2) defining a suction and compression chamber (5) communicating with outside through a liquid distribution channel (7); a manually actuated piston (8) slidingly coupled to said hollow body (2); elastic means (12) cooperating with a push button (83) connected to said piston; first valve means (13) adapted to connect said suction chamber (5) with a liquid suction tube (6); second valve means (14) adapted to connect said suction and compression chamber (5) with said distribution channel (7) during the delivery phase. Said distribution channel (7) has a first stationary part (71) made in the plug (23) and a second swinging part (30) consisting of a tube (13) having at the end facing the first stationary part (71) a substantially spherical body (32) whose outer surface closes the first stationary part when said second part is substantially perpendicular to the first part.

14 Claims, 5 Drawing Sheets

BELLOWS PUMP FOR DELIVERY OF LIQUIDS

The present invention relates to a delivery bellows pump adapted to be applied on a bottle or a container for liquids such as soaps, detergents and so forth. The bellows pumps of the prior art are generally pumps in which the liquid sucked from the container is held in the pump body outside the container because the entire pump excepting the sucking tube, is arranged above the closing plug of the container.

If this constructional system on the one hand limits the space lost inside the container for arranging the pump device instead of liquid to be delivered, on the other hand the transposition of the pump body on the outer part on the container causes non-negligible drawbacks.

One of the main drawbacks is that after delivery, the liquid sucked by the bellows returning to the rest position, is held inside the pump body, therefore outside the container. Consequently if the container together with the relevant pump is moved from its vertical position, it may happen that the liquid comes out from the pump through the delivery duct without an explicit will to deliver liquid.

Clearly this is an important drawback limiting the positive features of the bellows pump, said features being highlighted by the fact that the bellows pump are generally made of plastic materials without metal members and therefore they can be fully recycled. Moreover the bellows pumps allow to make smaller containers with the same liquid contents because the room up to now used by the pump inside the container is now transposed on the container head.

Another drawback of the bellows pump however like other pumps for delivery of liquids from containers, consists in that unintentional impacts, undesired forces applied on the bellows head cause the pump to be actuated and therefore the liquid to be delivered.

Therefore there is the need to provide bellows pumps with devices preventing the accidental delivery of liquid by overturning the container and also the unintentional operation of the bellows.

The Japanese publication JP10101119-A discloses a bellows pump solving the problem of unintentional liquid discharge from the delivery duct by providing a valve arranged on said delivery duct. The same document provides also a further device consisting of an annular band arranged between the bellows push button and the pump body so as to prevent accidental movements of the bellows and the liquid delivery.

The drawback of such a device is that the bellows blocking ring must be applied or removed whenever the operation of the pump must be blocked, involving also the trouble to keep at disposal the ring as a detached part of the pump.

The object of the present invention is to overcome the above mentioned limits and drawbacks.

Indeed an object of the invention is to provide a bellows pump in which the delivery duct can be easily closed or opened according to the needs.

Another object to be obtained is a tight closure of the delivery duct so as to make loss of liquid from the container to the outside impossible.

Another object to be obtained is to provide a simple device for blocking the pump stroke which is always available.

Another object is to provide a bellows pump with a limited size, anyway with plan dimensions falling inside the diameter of the push button or the plug screwed on the container.

This has the object to make easier all the stockage and packing operations of the container provided with the pump of the invention, so that the overall dimensions are reduced to the minimum and at the same time the pump tightness is warranted.

A last but not least object is to carry out a bellows pump comprising few parts, that can be easily assembled with automatic machinery.

All the above indicated objects and others that will be better pointed out hereinafter are attained by a bellows pump for delivery of a liquid stored in a container, said pump being fixed to the container neck through a plug being part of the pump, having the features according to the preamble of the main claim, where such a pump is characterized in that the liquid delivery channel connected to the pump has a first stationary part made in the pump plug and a second part swinging around a generally horizontal axis, said second rotary part consisting of a tube having the end facing the first stationary part in the form of a generally spherical body whose outer surface is adapted to close the first stationary part of said delivery channel when said second part is substantially perpendicular to the first part.

According to a preferred embodiment of the invention the outer surface of the spherical body of the second swinging part of the delivery channel is made of a soft material adapted to warrant the tight closure of the delivery channel.

Moreover when the second swinging part is arranged in a position substantially perpendicular to the first part, the free end of said second part is lodged under the bellows push button thus preventing said bellows to be pressed down thus to actuate the pump and deliver the liquid unintentionally.

Therefore the invention carries out a delivery device attaining at the same time the object to close the liquid delivery duct and to block also the pump actuating means.

Further features and characteristics of the invention will become more apparent from the description of a preferred embodiment of the invention given as an illustrative but non-limiting example, shown in the accompanying sheets of drawings in which:

FIG. 1 is a longitudinal sectional view of the pump of the invention at the rest position, applied to the neck of a bottle;

FIG. 1*a* is a perspective view of the liquid distributing channel;

Figure 1:
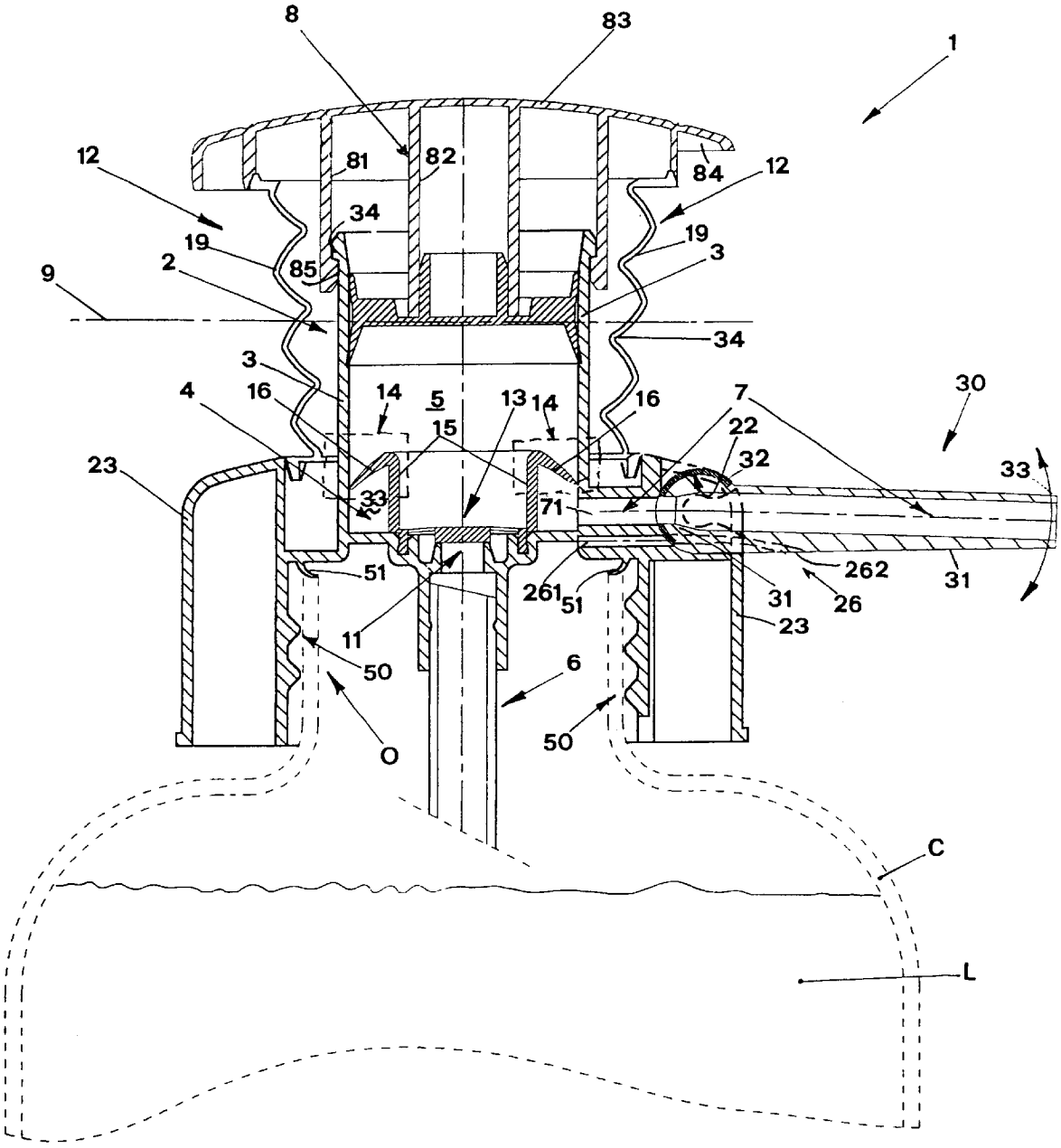

The pump of the invention is shown in FIG. 1 and generally indicated with reference numeral 1. The pump is intended to be applied on a container C to allow delivery of a liquid L charged in said container, generally consisting of soap or detergent.

The pump 1 comprises a hollow body consisting in the embodiment of a cylindrical body 2 having a vertical wall 3 defining a suction and compression chamber 5 communicating with the inside of the container C through a liquid suction tube 6. The tube 6 is inserted in a hole 11 made in the base 4 of said cylindrical body. The compression chamber 5 of the pump is in communication with the outside through a liquid distribution channel 7 comprising a stationary part and a rotary part as better explained hereinafter.

Figure 7:
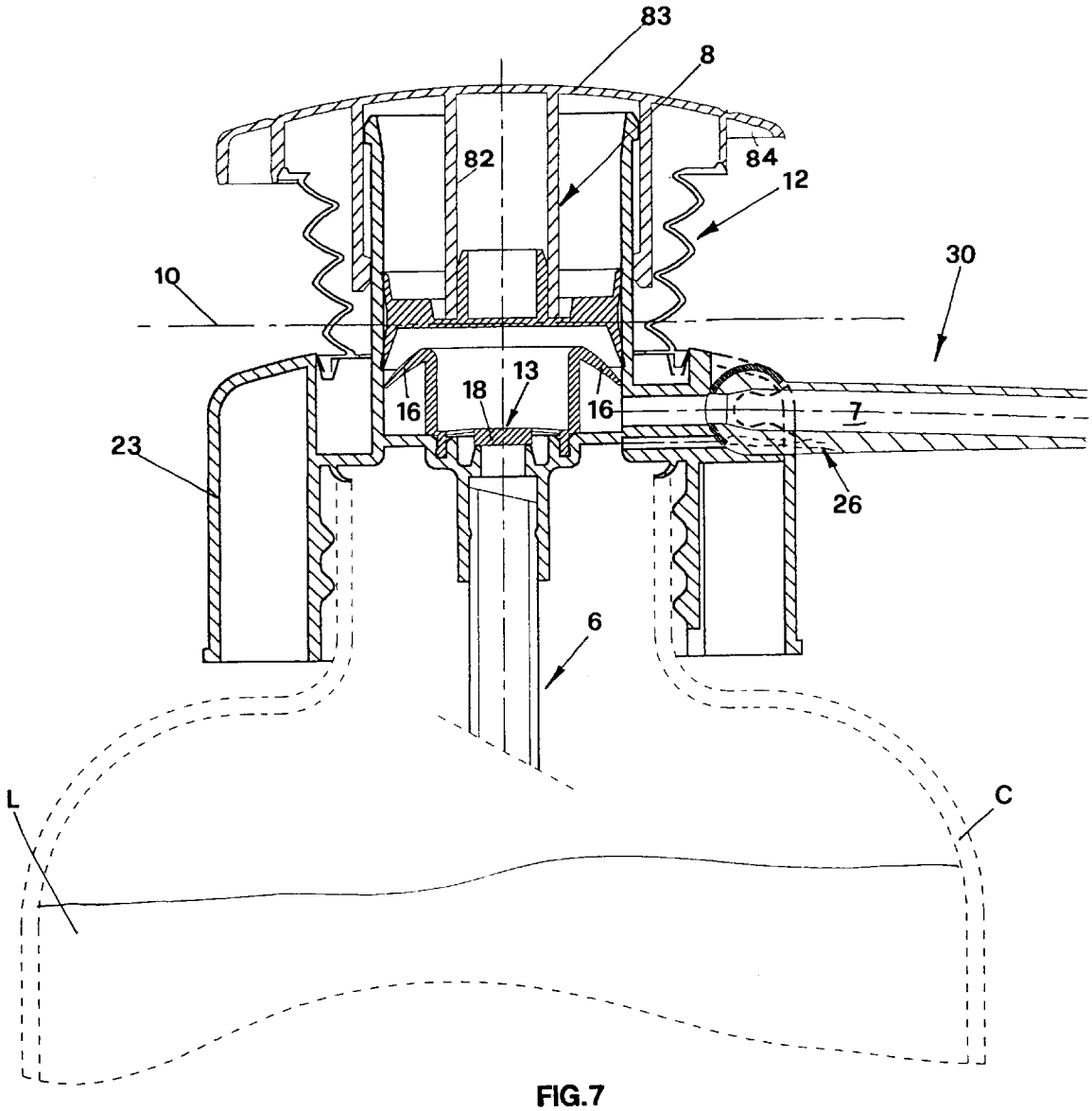
FIG. 7 is a view of the pump of FIG. 2 in the position taken at the end of the delivery phase.

A manually operated piston 8 coupled to cylinder 2 slides along the vertical inner wall 3 of cylinder 2, moving from an upper rest position 9 shown in FIG. 1 to a lower position of resetting the rest position indicated with numeral 10 in FIG. 7.

More particularly the suction chamber 5 is defined by the walls of the cylindrical body 2, the piston 8 and the perforated base 4 whose hole is indicated with numeral 11 in FIG. 1.

Piston 8 is moved through the push button 83 connected to said piston by the tube 82 being part of the push button. The push button 83 is also provided with a lock preventing said push button to be detached from the pump body, for instance when the container full of liquid is raised grasping only said push button. The detachment is prevented by an annular relief 85 made in the cylindrical projection 81 of the push bottom 83. Such an annular relief 85 cooperates with a corresponding annular relief 34 made on the outer edge of the cylindrical hollow body 2. When assembling the push button 83 on the pump body 2, elasticity of the materials allows coupling of push button 83 and cylindrical body 2. When the piston 8 reaches the position of maximum compression as indicated at 10 in FIG. 7, return of the piston to the rest position 9 is obtained through the elastic action exerted by the elastic bellows 12. Such a bellows of the frustum conical shape is of the kind disclosed in U.S. Pat. No. 5,924,603 of the same applicant or equivalent type.

In this embodiment the bigger base of the truncated cone of bellows 12 is anchored to push button 83, while the smaller part is free to slide along a cylindrical groove created between the outer surface of the cylindrical hollow body 2 and the plug 23 that in this embodiment are made from an integral piece of elastic material.

First valve means indicated with numeral 13 arranged upstream the suction and compression chamber 5 are adapted to open and close the suction tube 6 so as to connect or close the suction and compression chamber 5 relative to the inside of the container C during the liquid suction and delivery phases respectively.

Figure 3:
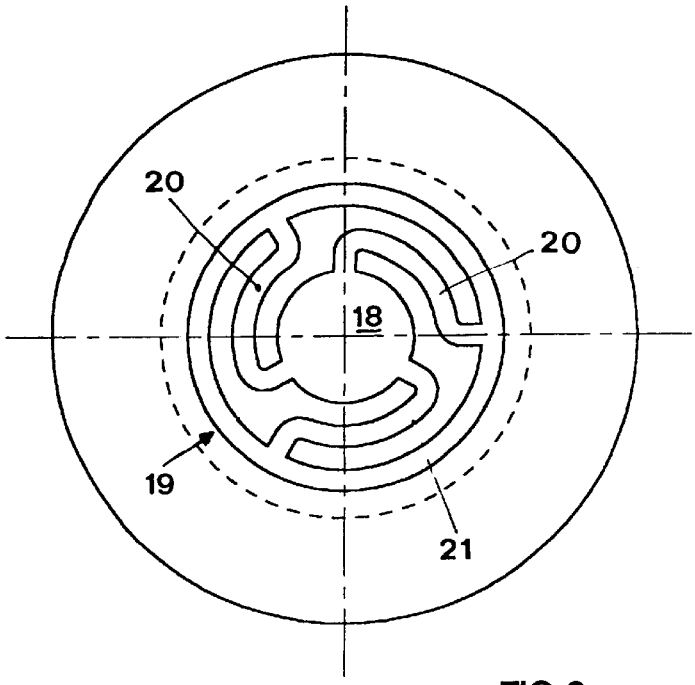
FIGS. 2 and 3 are a lateral sectional view and a plan view respectively, of the valve means provided in the pump of FIG. 1.
Figure 2:
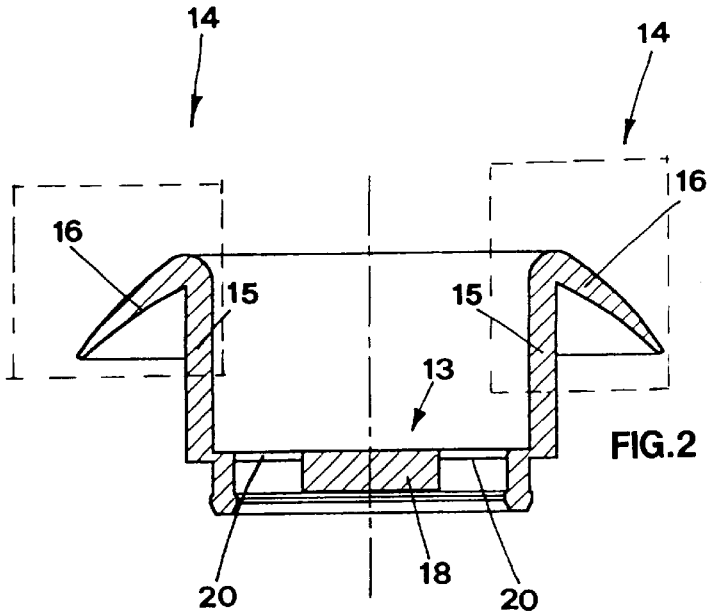

Said first valve means 13 consist of a first central portion 18 shown in FIGS. 2 and 3 and a second perimetral portion 19.

The first portion 18 is provided for leaning on the bounding edge 11*a* of hole 11 to warrant the tight closure of the suction tube 6 both in the rest position and the delivery phase. The second portion 19 consists of radial elastic tags 20 connected to the circular crown 21 allowing the central portion 18 to rise during the liquid suction phase.

Second valve means generally indicated with numeral 14, are arranged upstream the distribution channel 7 and are adapted to connect the chamber 5 with the distribution channel 7 during the pump compression phase so as to allow the liquid delivery.

Figure 4:
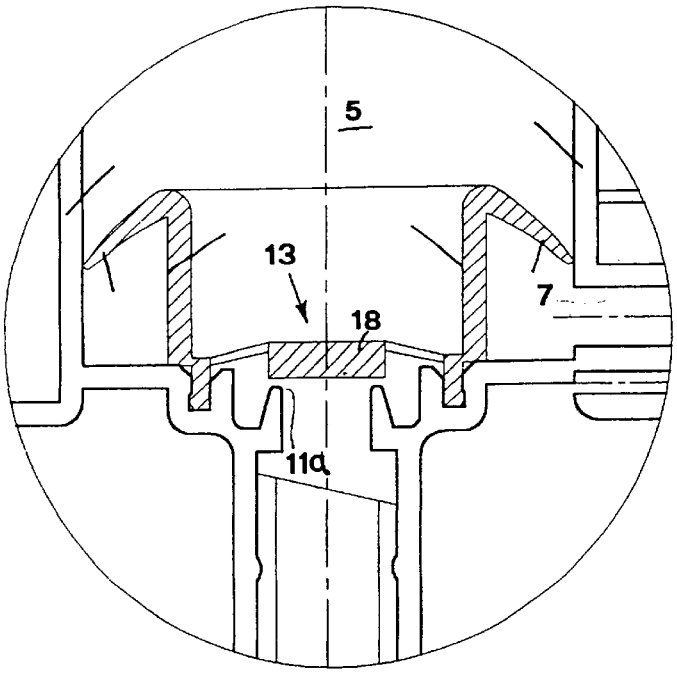
FIG. 4 is a view on an enlarged scale of the valve means of FIG. 2 in the suction phase.
Figure 5:
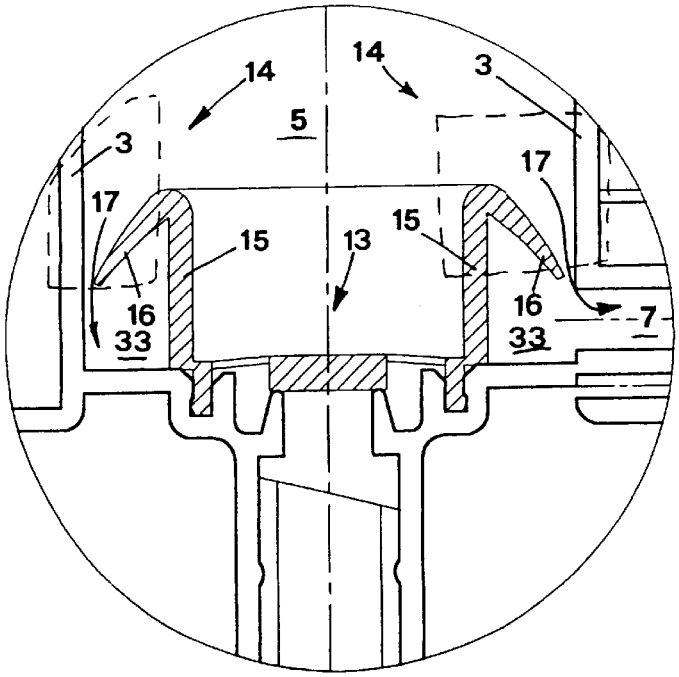
FIG. 5 is an enlarged view of the valve means of FIG. 2 in the delivery phase.

Said second valve means 14 consist of a generally cylindrical deforming element 15 shown in detail in FIGS. 2 and 3, comprising a projecting elastic annular lip 16 sealingly cooperating with the vertical wall 3 during the liquid suction phase as shown in FIG. 4. During the compression phase the annular lip 16 yields in view of the pressure of the liquid contained in chamber 5 and moves away from the wall 3 as shown in detail in FIG. 5 so as to define a communication route 17 with the distribution channel 7.

The circular radial lip 16 thus warrants the tightness of the suction and compression chamber 5 relative to the wall 3 of the cylinder 2 in the suction phase as well as when pump 1 is in the rest position, while allowing passage of liquid in the distribution channel during the compression phase.

In the present embodiment the first valve means 13 and second valve means 14 are advantageously made by a single piece of elastomeric material of which the piston 8 is also made.

According to the invention, the distribution channel 7 has a first stationary part 71 which is a duct made in the pump plug 23, and a second part 30 swinging around a generally horizontal axis. This second part 30 essentially consists of a tube 31 connected to the stationary part through a generally spherical end 32 whose outer surface allows to close the distribution channel 7 when this second part 30 is substantially perpendicular to the first part. In FIG. 1 the distribution channel 7 can be seen ready to deliver the liquid during the compression phase, while in FIG. 6 the second part 30 of the distribution channel 7 is substantially perpendicular to the first part 71 and the spherical surface 32 closes the delivery duct.

Figure 1A:
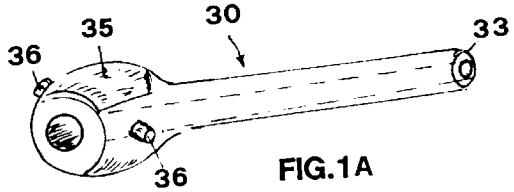
Figure 6:
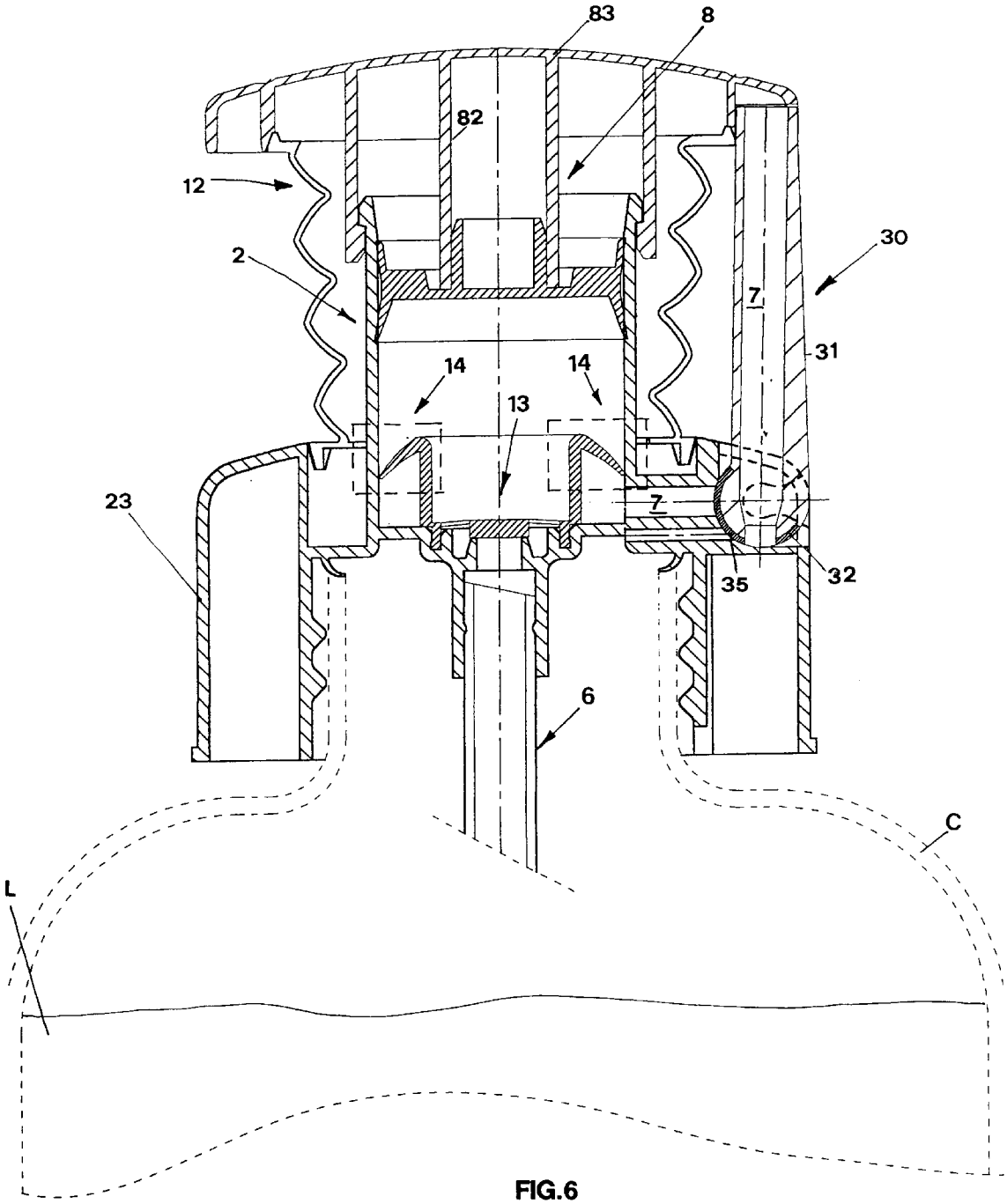
FIG. 6 is a view of the pump of FIG. 1 blocked in its rest position.

Advantageously according to an embodiment of the invention and as shown in FIG. 1*a*, the outer surface 35 of the spherical body 32 is covered by such a soft material as to allow the tight closure of the distribution channel 7 when the second part 30 of said channel is placed in a vertical or nearly vertical position as shown in FIG. 6.

The soft portion 35 may be made with the known process of joint injection of the soft material such as rubber when molding the plastic material of the second part 30 of the distribution channel 7.

Advantageously according to the invention in the vertical position shown in FIG. 6, the end part 33 of the distribution channel 7 is arranged in the room 84 created on the lower part of the push button 83.

It is clear that under these conditions an accidental pressure on the push button cannot actuate the piston 8 because the push button cannot be lowered in view of the presence of the distribution channel 7.

In this way a double advantage is obtained, namely that in the vertical position of the swinging part 30 of the distribution channel 7 closure of the delivery duct and lock of the pump motion is obtained.

Another advantage is that in such a position the size of the pump is also considerably reduced because the delivery channel does not constitute an increase of the transversal dimension. This is particularly advantageous both in packing and displaying the containers provided with the pump of the invention, because the space required by the delivery duct protruding from the shape of the container or the push button, is nullified by the vertical position of the same duct. This is particularly valuable when the diameter of the liquid container is almost equivalent to the diameter of the pump plug. Indeed in this case a distribution channel of traditional type would certainly protrude from the shape of the container thus causing the above indicated problems of size.

The articulation of the second part 30 relative to the plug 23 is carried out through two generally cylindrical lugs indicated with numeral 36, engaged on corresponding recesses made on plug 23 not shown in the drawings.

As to the necessary compensation of the vacuum created in the container C by suction of the liquid, this can be obtained for instance through a little air intake channel 26 shown in FIG. 1 and FIG. 7 made in the distribution channel 7.

More particularly as shown in FIG. 1, the air intake channel 26 is made under the distribution channel 7 and also consists of a first stationary part 261 made in the plug 23 and a second moving part 262 belonging to the second rotary part 30 of the distribution channel 7. Also in this case when the distribution channel 7 is arranged in a horizontal position, thus in the liquid delivery position, the channel 26 connects the external ambient with the inner room of the container C so that during return of piston 8 to the rest position 9, restoration of air inside the container C occurs. On the contrary when the distribution channel 7 is arranged in the vertical position, also the air intake channel 26 is closed, because the first channel part 261 is closed by the spherical body 32 of the second rotary part 30. Closure is carried out again in a tight way by contact on the edge of the hole of the portion 35 made of soft material and suitable for a tight seal. It is to be noted that the closure of channel 26 ensures that liquid L contained inside the container C is never discharged, irrespective of the position of the container C, because both the channel 26 and the channel 7 from which liquid may be discharged, are closed.

Alternative solutions for compensation of air vacuum may be constituted by the same container C made of yielding material or simply by a yielding portion made in the wall of said container, as the yielding feature of such material allows to balance the vacuum.

As stated hereinbefore, in the preferred embodiment of the pump according to the present invention, the closing plug to be screwed on the container C and indicated with numeral 23, is made integral with the cylinder 2.

More particularly on the inner wall of plug 23 a thread 50 is made allowing to screw the plug and therefore the pump fixed to the plug, on the neck O of the container C. Moreover a circular lip 51 protruding downwards from plug 23, ensures tightness relative to the edge of the container C, on which said lip 51 is pressed at the end of screwing plug 23 around the neck O of container C.

In operation the user exerting manually a pressure on the push button 83, slides downwards piston 8 from the rest position 9 shown in FIG. 1 to the reset position 10 shown in FIG. 7. In this way the suction tube 6 is closed and the liquid L contained in the suction and compression chamber 5 is compressed. Increase of pressure inside the chamber 5 causes lip 16 to yield elastically, opening the distribution route 17 and allowing inflow of liquid into the distribution channel 7 and finally delivery of liquid L. At the end of delivery the user releases the push button 83 allowing the previously loaded elastic bellows 12 to return the piston 8 to the rest position 9.

This movement of piston 8 generates inside the suction and compression chamber 5 a vacuum closing the distribution route 17 and raising the central portion 18 of valve 13 opening the suction tube 7. The liquid L flows inside the suction and compression chamber 5 and the pump 1 is ready for the next delivery.

At the end of the drawing operations or when transportation of the container with the pump is desired, the distribution channel is rotated upwards as shown in FIG. 6 so as to obtain both lock of all the liquid outlets and lock of the stroke of bellows 12 of the pump.

As illustrated by this description, with the pump of the invention all the advantages relating to the construction of a bellows pump are obtained, in other words substantially a pump made only with plastic materials or anyway non-metallic materials.

The objects of the invention are also attained consisting in providing a container having a pump of easy use and safe tightness in which the distribution channel is put in a closing position through its simple rotation. Moreover said distribution channel in the closing position ensures against unintentional movements of the pump.

What is claimed is:

1. A delivery pump (1) for a liquid filled in a container (C), connected to the neck of said container through a plug (23) being a part of said pump, comprising:

a cylindrical hollow body (2) defining a suction and compression chamber (5) communicating with the inside of said container (C) through a suction tube (6) inserted in a hole made on the base (4) of said cylindrical body and with the outside through a liquid distribution channel (7);

a manually actuated piston (8) slidingly coupled to said hollow body (2) and movable from an upper rest position (9) to a lower position (10) resetting said rest position (9);

elastic means (12) cooperating with a push button (83) connected to said piston and adapted to reset the rest position of said piston;

first valve means (13) arranged upstream said suction and compression chamber (5) adapted to connect said suction chamber (5) with said suction tube (6) during the sucking stage of said liquid (L);

second valve means (14) arranged upstream said distribution channel (7) adapted to connect said suction and compression chamber (5) with said distribution channel (7) during the delivery phase;

wherein said distribution channel (7) has a first stationary part (71) made in the plug (23) of said pump and a second part (30) swinging around a generally horizontal axis, said second rotary part (30) consisting of a tube (31) provided at the end facing the first stationary part (71) with a substantially spherical body (32) whose outer surface is adapted to close the first stationary part of said distribution channel when said second part is substantially perpendicular to the first part.

2. The pump according to claim 1) wherein said substantially spherical body of said second rotary part (30) has at least a portion (35) of the outer surface made of soft material adapted to ensure the tight closure of the distribution channel when said second rotary part is substantially perpendicular to said first part of the distribution channel.

3. The pump according to claim 1) wherein the end portion (33) of the tube (31) belonging to the second rotary part (30) of the distribution channel (7) is arranged in a room (84) created on the lower part of the push button (83) so as to prevent operation of said pump when said second rotary part is arranged perpendicularly to said first part.

4. The pump according to claim 1 wherein said push button (83) has an annular relief (85) cooperating with a corresponding relief (34) made on the outer edge of the cylindrical body of the pump so as to prevent detachment of said push button from said pump body.

5. The pump (1) according to claim 1) wherein said first valve means (13) consist of a substantially flat element having a first central circular portion (18) and a second perimetral portion (19) provided with radial elastic tags (20) connected to an annular peripheral part (21).

6. The pump (1) according to claim 1) wherein said second valve means (14) consist of a substantially cylindrical deforming element (15) comprising a projecting elastic annular lip (16) sealingly cooperating with said vertical wall (3) during the suction phase of said liquid (L), said annular lip (16) moving away from said vertical wall (3) during the compression and delivery phase to define a communication route (17) with the distribution channel (7) of said liquid.

7. The pump (1) according to claim 6) wherein said deforming valve element (14) consists of an elastomeric membrane.

8. The pump (1) according to claim 1) characterized by comprising compensation means (26) of the vacuum created in container (C) by suction of said liquid (L).

9. The pump (1) according to claim 8) wherein said vacuum compensation means consist of an air intake channel (26) made in said distribution channel (7).

10. The pump (1) according to claim 9) wherein said substantially spherical body (32) of said second rotary part (30) closes said air intake channel (26) when said second part is placed substantially perpendicularly to the first part.

11. The pump (1) according to claim 1 wherein said closing plug (23) is integral with said cylinder (2).

12. The pump (1) according to claim 1) wherein said first valve means (13) and said second valve means (14) are made by a single piece.

13. The pump according to claim 1) wherein said elastic means cooperating with the push button (83) consist of a bellows (12).

14. The pump according to claim 13) wherein said bellows has a generally frustum conical shape with the bigger base in contact with said push button.

* * * * *